US007100309B2

(12) United States Patent
Smith et al.

(10) Patent No.: US 7,100,309 B2
(45) Date of Patent: Sep. 5, 2006

(54) TRACK SHOE WITH HEEL PLATE AND SUPPORT COLUMNS

(75) Inventors: Steven F. Smith, Lake Oswego, OR (US); John A. Truax, Portland, OR (US)

(73) Assignee: Nike, Inc., Beaverton, OR (US)

( * ) Notice: Subject to any disclaimer, the term of this patent is extended or adjusted under 35 U.S.C. 154(b) by 171 days.

(21) Appl. No.: 10/758,959

(22) Filed: Jan. 16, 2004

(65) Prior Publication Data

US 2005/0155254 A1 Jul. 21, 2005

(51) Int. Cl.
*A43B 13/18* (2006.01)
*A43B 5/00* (2006.01)

(52) U.S. Cl. ..... 36/28; 36/27; 36/35 R; 36/37; 36/114

(58) Field of Classification Search ..... 36/129, 36/27, 28, 7.8, 37, 38, 35 R, 67 R, 134
See application file for complete search history.

(56) References Cited

U.S. PATENT DOCUMENTS

| | | | | | |
|---|---|---|---|---|---|
| 1,088,328 | A | * | 2/1914 | Cucinotta | 36/28 |
| 3,822,488 | A | * | 7/1974 | Johnson | 36/129 |
| 3,886,674 | A | * | 6/1975 | Pavia | 36/38 |
| 4,183,156 | A | | 1/1980 | Rudy | 36/44 |
| 4,219,945 | A | | 9/1980 | Rudy | 36/29 |
| 4,255,877 | A | | 3/1981 | Bowerman | 36/129 |
| 4,287,675 | A | | 9/1981 | Norton et al. | 36/129 |
| 4,288,929 | A | | 9/1981 | Norton et al. | 36/69 |
| 4,354,318 | A | | 10/1982 | Frederick et al. | 36/30 R |
| 4,364,188 | A | * | 12/1982 | Turner et al. | 36/31 |
| 4,364,189 | A | | 12/1982 | Bates | 36/31 |
| 4,492,046 | A | | 1/1985 | Kosova | 36/27 |
| 4,559,724 | A | | 12/1985 | Norton | 36/129 |
| 4,566,206 | A | | 1/1986 | Weber | 36/7.8 |
| 4,949,476 | A | | 8/1990 | Anderie | 36/129 |
| 5,159,767 | A | | 11/1992 | Allen | 36/27 |
| 5,203,095 | A | | 4/1993 | Allen | 36/27 |
| 5,247,742 | A | | 9/1993 | Kilgore et al. | 36/114 |
| 5,343,639 | A | | 9/1994 | Kilgore et al. | 36/29 |
| 5,353,523 | A | | 10/1994 | Kilgore et al. | 36/29 |
| 5,367,790 | A | | 11/1994 | Gamow et al. | 36/27 |
| 5,435,079 | A | * | 7/1995 | Gallegos | 36/38 |
| 5,701,686 | A | | 12/1997 | Herr et al. | 36/27 |
| 6,029,374 | A | | 2/2000 | Herr et al. | 36/27 |
| 6,161,315 | A | * | 12/2000 | Dalton | 36/134 |
| 6,282,814 | B1 | * | 9/2001 | Krafsur et al. | 36/27 |
| 6,289,611 | B1 | * | 9/2001 | Patterson et al. | 36/127 |
| 6,449,878 | B1 | | 9/2002 | Lyden | 36/27 |
| 6,457,261 | B1 | * | 10/2002 | Crary | 36/27 |
| 6,487,796 | B1 | * | 12/2002 | Avar et al. | 36/28 |
| 6,568,102 | B1 | * | 5/2003 | Healy et al. | 36/28 |
| 6,601,042 | B1 | | 7/2003 | Lyden | 705/26 |
| 6,898,870 | B1 | * | 5/2005 | Rohde | 36/28 |
| 6,928,756 | B1 | * | 8/2005 | Haynes | 36/27 |
| 2003/0069807 | A1 | | 4/2003 | Lyden | |

* cited by examiner

*Primary Examiner*—Marie Patterson
(74) *Attorney, Agent, or Firm*—Banner & Witcoff, Ltd.

(57) ABSTRACT

An article of footwear includes an upper and a sole structure secured to the upper. The sole structure includes an outsole secured to the upper and a plurality of gripping elements extending outwardly from the outsole. A heel plate extends downwardly and rearwardly from a midfoot portion of the outsole. A first support column extends between the outsole and the heel plate, with the first column being positioned in a lateral portion of a heel portion of the outsole. A second support column extends between the outsole and the heel plate, with the second column being positioned in a medial portion of the heel portion of the outsole.

22 Claims, 3 Drawing Sheets

TRACK SHOE WITH HEEL PLATE AND SUPPORT COLUMNS

FIELD OF THE INVENTION

This invention relates generally to track shoes, and more particularly, to track shoes having a heel plate with support columns.

BACKGROUND OF THE INVENTION

Track shoes used by sprinters are highly specialized articles of athletic footwear. They include an upper formed of leather, synthetic materials, or a combination thereof, which receives the foot while providing ventilation and protection from the elements. A sole of the shoe includes multiple layers that are conventionally referred to as an insole, midsole, and outsole. The insole is a thin, padded member located adjacent to the foot that improves the comfort of the shoe. The midsole forms the middle layer of the sole and often incorporates a resilient foam material that attenuates shock and absorbs energy when the shoe makes contact with the ground. The outsole includes gripping elements, or spikes, on its lower surface in the forefoot region in order to improve traction. The outsole is fashioned from a rigid material in order to carry the forces transmitted by the spikes.

When a sprinter is running, their heels are elevated and preferably do not come into contact with the ground. Rather, the initial impact with the ground occurs with ball of the foot, and, more specifically with the lateral portion of the ball of the foot. After initial impact, the typical rolling movement occurs, with the foot rolling toward the medial side and the toes to the toe-off or launch position.

Often a sprinter will tire as they approach the end of the race, and their ability to keep their heels elevated decreases. As the user's heels start to drop, their ability to effectively and efficiently transfer power through the spikes in the ball of their foot decreases as well.

U.S. Pat. No. 4,949,476 to Anderíe discloses a running shoe having a front sole of hard plastic material from which a plurality of gripping elements protrude. The sole extends rearwardly past the ball region of the foot into the over a wedge-shaped element formed of a foam material that is relatively hard but elastically pressure-deformable. In certain embodiments, a low heel member is provided in the heel region. The heel member is shallow enough so that it does not contact the track surface when the user is sprinting, but merely acts as a safeguard against tipping back. Anderíe is limiting in that it provides support for the user's foot only through the midfoot, and does not provide any support for the heel when the user is running in the event that the user's heel starts to drop.

It is an object of the present invention to provide a track shoe with a heel plate and support columns that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a track shoe with a heel plate and support columns that helps to maintain a sprinter's foot in proper position as they tire and their heel starts to drop while sprinting.

In accordance with a first aspect, an article of footwear includes an upper and a sole structure secured to the upper. The sole structure includes an outsole secured to the upper and a plurality of gripping elements extending outwardly from the outsole. A heel plate extends downwardly and rearwardly from a midfoot portion of the outsole. A first support column extends between the outsole and the heel plate, and is positioned in a lateral portion of a heel portion of the outsole. A second support column extends between the outsole and the heel plate, and is positioned in a medial portion of the heel portion of the outsole.

In accordance with another aspect, an article of footwear includes an upper and a sole structure secured to the upper. The sole structure includes an outsole secured to the upper and a plurality of spikes extending outwardly from the outsole. A plurality of projections extends outwardly from the outsole. A heel plate extends downwardly and rearwardly from a midfoot portion of the outsole to a point below a heel portion of the outsole. A plurality of projections extends outwardly from the heel plate. A first support column extends between the outsole and the heel plate, and is positioned in a lateral portion of the heel portion of the outsole. A second support column extends between the outsole and the heel plate, and is positioned in a medial portion of the heel portion of the outsole and forwardly of the first support column.

In accordance with a further aspect, an article of footwear includes an upper and a sole structure secured to the upper. The sole structure includes a midsole secured to the upper and an insole positioned within the upper above the midsole. An outsole is secured to the midsole, and a plurality of spikes extends outwardly from the outsole. A plurality of projections extends outwardly from the outsole. A heel plate extends downwardly and rearwardly from a midfoot portion of the outsole to a point below a heel portion of the outsole. A plurality of projections extends outwardly from the heel plate. A first support column extends between the outsole and the heel plate, and is positioned in a lateral portion of the heel portion of the outsole. A second support column extends between the outsole and the heel plate, and is positioned in a medial portion of the heel portion of the outsole and forwardly of the first support column.

Substantial advantage is achieved by providing a track shoe with a heel plate and support columns. In particular, when a sprinter starts to tire at the end of a race, the present invention provides support for the heel in order to maintain the user's foot in the proper sprinting position.

These and additional features and advantages of the invention disclosed here will be further understood from the following detailed disclosure of certain preferred embodiments.

Figure 1:
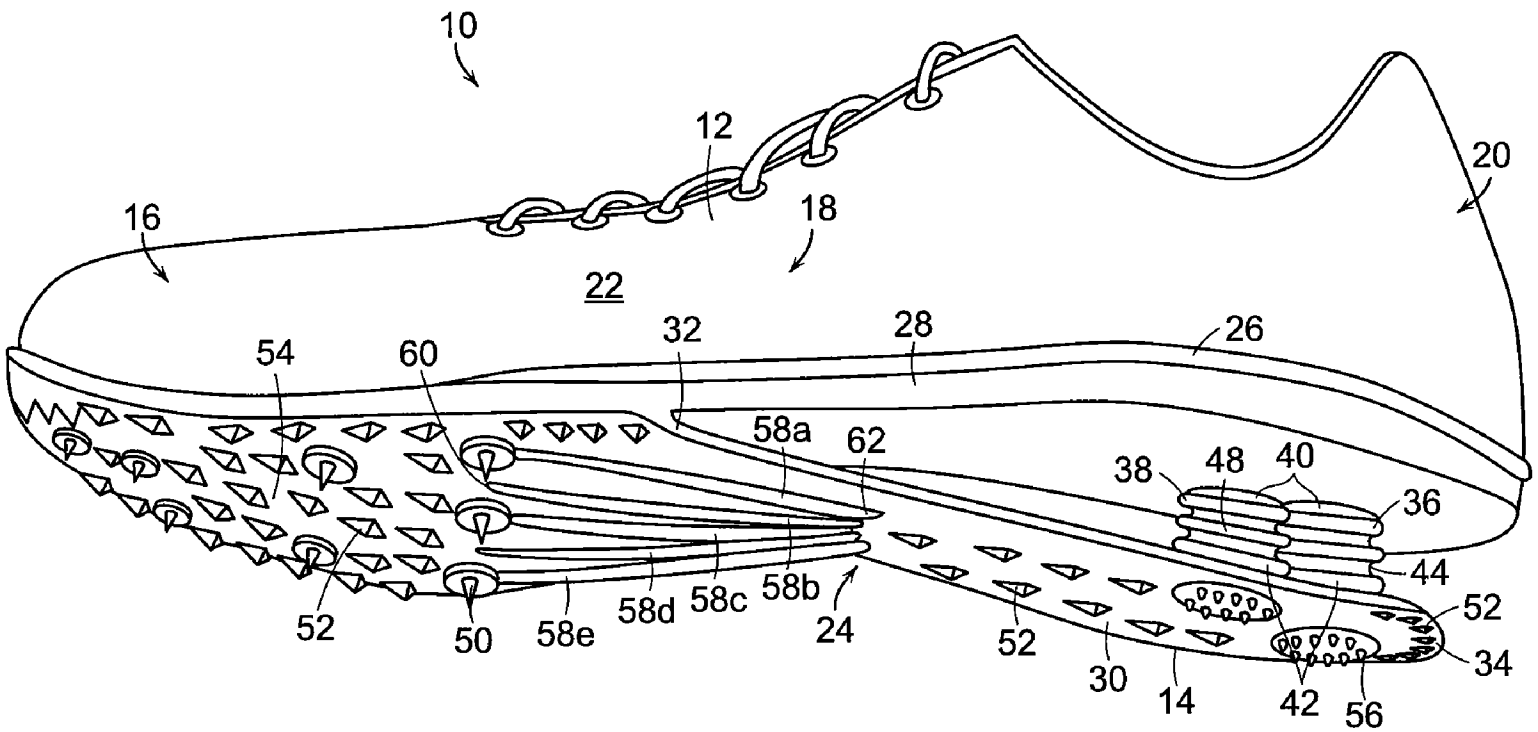
FIG. 1 is a perspective view of an article of footwear with a heel plate and support columns in accordance with a first embodiment of the present invention.

The figures referred to above are not drawn necessarily to scale and should be understood to present a representation of the invention, illustrative of the principles involved. Some features of the track shoe with a heel plate and support columns depicted in the drawings have been enlarged or distorted relative to others to facilitate explanation and understanding. The same reference numbers are used in the drawings for similar or identical components and features shown in various alternative embodiments. A track shoe with a heel plate and support columns as disclosed herein, would have configurations and components determined, in part, by the intended application and environment in which they are used.

DETAILED DESCRIPTION OF CERTAIN PREFERRED EMBODIMENTS

Figure 2:
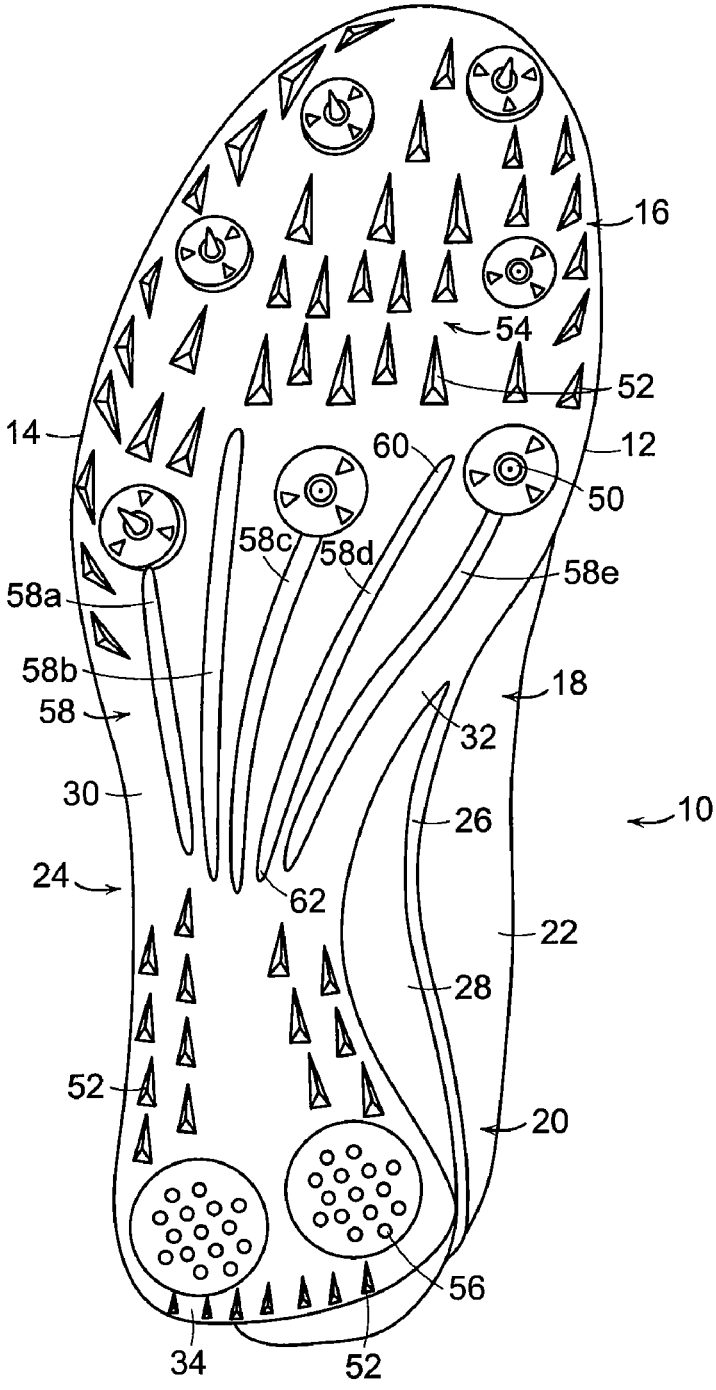
FIG. 2 is a bottom plan view of the article of footwear of FIG. 1.
Figure 3:
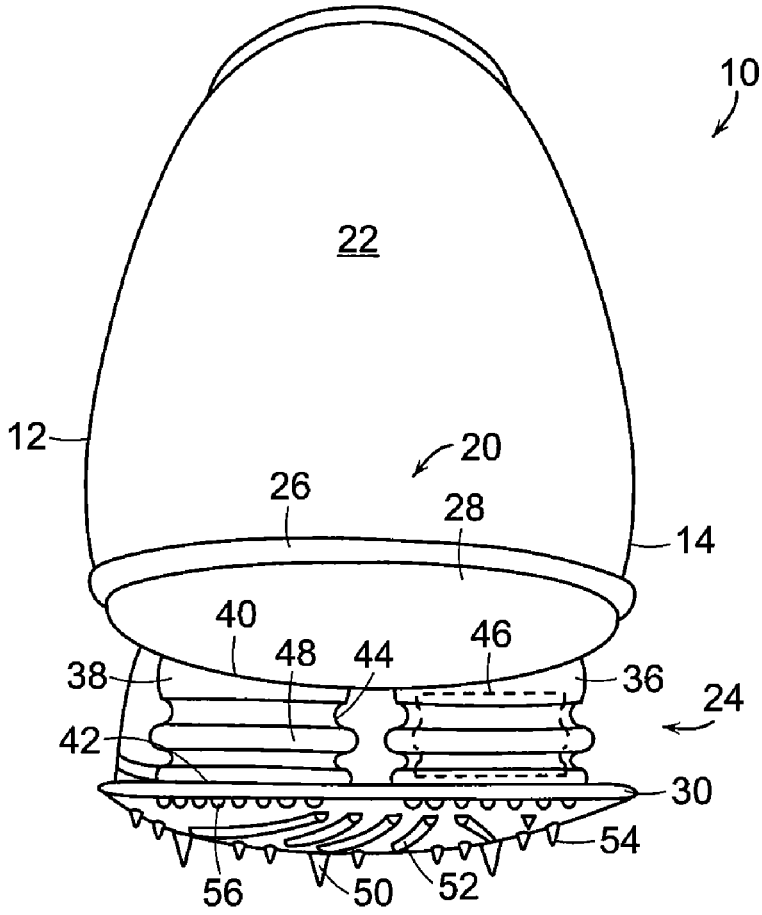
FIG. 3 is a rear elevation view of the article of footwear of FIG. 1.

The present invention may be embodied in various forms. A preferred embodiment of an article of footwear 10 is shown in FIGS. 1–3. Footwear 10 has a medial, or inner, side 12 and a lateral, or outer, side 14. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion. The figures illustrate only the article of footwear intended for use on the right foot of a wearer. One skilled in the art will recognize that a left article of footwear, such article being the mirror image of the right, is intended to fall within the scope of the present invention.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the right as seen in FIG. 1. Naturally, forwardly is toward forefoot portion 16, that is, to the left as seen in FIG. 1, and downwardly is toward the bottom of the page as seen in FIG. 1. Inwardly is toward the center of footwear 10, and outwardly is toward the outer peripheral edge of footwear 10.

Footwear 10 includes an upper 22, and a sole structure 24 secured to upper 22. Sole structure 24 may be secured to upper 22 by an adhesive, or any other suitable fastening means. Upper 22 receives and comfortably secures footwear 10 to a foot of a wearer. Sole structure 24, which is generally disposed between the foot of the wearer and the ground, primarily provides traction for the runner as footwear 10 repetitively contacts the ground during a race. As with conventional articles of athletic footwear, sole structure 24 includes an insole (not shown) located within upper 12, a midsole 26, and an outsole 28. Midsole 26 is attached to upper 22 and functions as the primary shock-attenuating and energy-absorbing component of footwear 10. Outsole 28 is attached to the lower surface of midsole 26 and is preferably formed of a stiff material, providing support for the runner's foot in the sprinting position. Suitable materials for outsole 28 include polymers, e.g., polyether-block co-polyamide polymers (sold as Pebax® by ATOFINA Chemicals of Philadelphia, Pa.), and nylon resins such as Zytel®, sold by Dupont. Other suitable materials for outsole 28 will become readily apparent to those skilled in the art, given the benefit of this disclosure.

With many individuals, the typical motion of the foot during running proceeds as follows: First, the heel strikes the ground, followed by the ball of the foot. As the heel leaves the ground, the foot rolls forward such that the toes make contact, and finally the entire foot leaves the ground during toe-off, or launch to begin another cycle. While in contact with the ground, the foot typically rolls from the outside or lateral side to the inside or medial side, a process called pronation. That is, normally the outside of the heel strikes first and the toes on the inside of the foot leave the ground last. While the foot is airborne and preparing for another cycle, the opposite process, called supination, occurs. When sprinters race, however, it is the lateral side of the ball of the foot that first strikes the ground; the heel preferably never hits the ground. As the heel lifts, the foot rolls forward such that the toes make contact until launch when the foot leaves the ground to begin another cycle.

In order to support the runner's heel and prevent the heel from striking the ground, a heel plate 30 is advantageously provided beneath outsole 28. A first or front end 32 of heel plate 30 is secured to outsole 28 at midfoot portion 18. Heel plate 30 extends downwardly and rearwardly from outsole 28 to a second or rear end 34, which is positioned beneath heel portion 20 of footwear 10. Heel plate 30 serves to elevate the heel of the user. This is highly advantageous when such footwear is used by sprinters, since it is desirable for a sprinter's heel to remain elevated in the proper sprinting position.

In a preferred embodiment, heel plate 30 is formed of the same material as outsole 28. In certain preferred embodiments, heel plate 30 is of unitary, that is, one-piece construction with outsole 28. Heel plate 30 and outsole 28 may be co-molded. In other embodiments, heel plate 30 and outsole 28 may be separate components, secured to one another by adhesive or other suitable fastening means.

A first or lateral compressible support column 36 is disposed between outsole 28 and heel plate 30 in a lateral area of heel portion 20 of footwear 10. A second or medial compressible support column 38 is disposed between outsole 28 and heel plate 30 in a medial area of heel portion 20 of footwear 10. Both lateral support column 36 and medial support column 38 are positioned beneath and provide support for the heel of a runner in the event that their heel drops while sprinting. Heel plate 30 is able to distribute forces among support columns 36, 38.

In a preferred embodiment, medial support column 38 is positioned slightly forward of lateral support column 36. Thus, on impact at the lateral side of heel portion 20, support is provided initially by lateral support column 36. As the runner's foot starts to roll to the medial side, support from medial support column 38 is provided. This positioning of lateral support column 36 with respect to medial support column 38 helps to compensate for any over-pronation. In certain preferred embodiments, lateral support column 36 has a diameter slightly larger than that of medial support column 38. As illustrated here, heel plate 30 is slightly longer on lateral side 14 than on medial side 12 to accommodate lateral support column 36, which is positioned slightly further back along heel portion 20 than medial support column 38.

Each of support columns 36, 38 includes an upper surface 40 that is attached to outsole 28, a lower surface 42 that is attached to heel plate 30, and an exposed exterior surface 44 that extends between upper surface 40 and lower surface 42. Upper surface may be secured to outsole 28 and heel plate 30 and lower surface 42 may be secured to heel plate 30 by an adhesive.

As depicted in FIGS. 1, 3, each of support columns 36, 38 has a generally cylindrical configuration. Within the scope of the present invention, however, support columns 36, 38 may have a variety of other columnar configurations including spherical, pyramidal, cubic, conic, or any other regular geometric shape. In addition to regular shapes, support columns 36, 38 may have an irregular geometric shape. Accordingly, support columns 36, 38 may have a variety of configurations that perform the functions described herein. Suitable materials for support columns 36, 38 include rubber, polyurethane foam, microcellular elastomeric foams, or phylon (EVA foam). Other suitable materials for support columns 36, 38 will become readily apparent to those skilled in the art, given the benefit of this disclosure.

Support columns 36, 38 serve to attenuate shocks and absorb energy in the event that the user tires and footwear 10 initially contacts the ground in the heel portion 20. Each support columns 36, 38 may include an interior void 46, as illustrated in FIG. 3. Each support columns 36, 38 may also include a plurality of physical features, including a smooth surface, circumscribing ridges, one or more circumscribing indentations, one or more circumscribing indentations that include one or more ribs, rings, or indicia, as disclosed in commonly owned U.S. Pat. Nos. 5,353,523 and 5,343,639 to Kilgore et al., the entire disclosures of which are incorporated herein by reference. In the illustrated embodiment, support columns 36, 38 include a circumferential rib 48 on exterior surface 44. The compliance of each support columns 36, 38 may be altered by repositioning rib 48. For example, each support columns 36, 38 may be configured for greatest compliance by positioning rib 48 adjacent either top surface 40 or bottom surface 42. The least amount of compliance is achieved by centrally-locating rib 48, as depicted in FIG. 3. By altering the compliance of support columns 36, 38, an individual may configure footwear 10 to have proper shock attenuation and energy absorption for the particular weight of the individual.

Outsole 28 preferably includes a plurality of gripping elements such as spikes 50 and projections 52. The gripping elements provide superior traction for the sprinter as they propel themselves forward from the launch position. Spikes 50 may be fixed and permanently secured to outsole 28 as illustrated in this embodiment, or they may be removably secured to outsole 28, such as by threads. In the illustrated embodiment, there are seven spikes 50 positioned in forefoot portion 16. Three spikes 50 are positioned along lateral side 12 of forefoot portion 16, three more along medial side 14, and one positioned centrally at a rear edge of forefoot portion 16 so as to be positioned at the rear edge of the ball of the foot of the user, with this spike being positioned between one spike on lateral side 14 and one spike on medial side 12. It is to be appreciated that more or less than seven spikes may be positioned in forefoot portion 16 of outsole 28.

It is to be appreciated that the specific shape, size and location of projections 52 may vary. In the illustrated embodiment, a plurality of projections 52 takes the shape of pyramids. More specifically, the projections 52 positioned within a central area 54 of forefoot portion 16 of outsole 28 are triangular pyramids, with an apex of their triangular base having an acute angle and pointing generally toward the front of footwear 10. Similarly, a plurality of projections 52 are positioned on heel plate 30. As illustrated here, projections 52 are also triangular pyramids, with an apex of their triangular base having an acute angle pointing generally toward the front of footwear 10. Further, a plurality of projections 56 are positioned beneath each of support columns 36, 38, with projections 56 having a generally conical shape in the illustrated embodiment. Spikes 50 and projections 52, 56 serve to provide the user with superior traction on the running surface.

In a preferred embodiment, a plurality of ribs 58 extends beneath the point at which heel plate 30 joins outsole 28. Specifically a first end 60 of each rib 58 is located at a rear area of forefoot portion 16 of outsole 28, forward of the point where heel plate 30 joins outsole 28. A second end 62 of each rib 58 is located at a rear end of midfoot portion 18 of heel plate 30, rearward of the point where heel plate joins outsole 28. Ribs 58 serve to provide additional structural rigidity for heel plate 30 at its point of connection to outsole 28. In the illustrated embodiment, there are five ribs 58, with a first rib **58*a* extending rearwardly from just behind the rearmost spike 50 on lateral side 14. A second rib 58*b* is positioned slightly inward of first rib 58*a*. A third central rib 58*c* extends rearwardly from just behind the spike 50 that is located centrally at a rear edge of forefoot portion 16. A fourth rib 58*d* is positioned slightly outwardly of third rib 58*c*, and a fifth rib 58*e* extends rearwardly from just behind the rearmost spike 50 on medial side 12. It is to be appreciated that the number and specific location of ribs 50** may vary from that illustrated in this embodiment.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper;

a sole structure secured to the upper and comprising:

an outsole secured to the upper;

a plurality of gripping elements extending outwardly from the outsole;

a heel plate having a first end and a second end, the first end being secured to a midfoot portion of the outsole and the heel plate extending downwardly and rearwardly from the first end to the second end;

a first support column extending between the outsole and the heel plate, the first column positioned in a lateral portion of a heel portion of the outsole;

a second support column extending between the outsole and the heel plate, the second column positioned in a medial portion of the heel portion of the outsole.

2. The article of footwear of claim 1, wherein the second support colunm is positioned forwardly of the first support column.

3. The article of footwear of claim 1, wherein a diameter of the first support column is larger than a diameter of the second support column.

4. The article of footwear of claim 1, wherein the gripping elements include a plurality of spikes.

5. The article of footwear of claim 1, wherein the gripping elements include a plurality of projections.

6. The article of footwear of claim 5, wherein the projections are pyramids.

7. The article of footwear of claim 6, wherein the pyramids have triangular bases.

8. The article of footwear of claim 7, wherein the triangular bases are triangles, with an apex of the triangle having an acute angle and pointing generally toward a front of the outsole.

9. The article of footwear of claim 5, wherein some of the projections are positioned beneath the support elements and have a conical shape.

10. The article of footwear of claim 1, wherein the heel plate extends to a point beneath a rear portion of a heel portion of the outsole.

11. The article of footwear of claim 1, wherein the heel plate is formed of a polymer.

12. The article of footwear of claim 1, wherein the outsole is formed of a polymer.

13. The article of footwear of claim 1, wherein the heel plate is of unitary construction with the outsole.

14. The article of footwear of claim 1, wherein each support column includes a central void.

15. The article of footwear of claim 1, wherein an exterior surface of each support column includes a circumferential rib.

16. The article of footwear of claim 1, wherein each support column is formed of one of rubber, polyurethane foam, microcellular elastomeric foams, or EVA foam.

17. The article of footwear of claim 1, further comprising a plurality of ribs, each rib extending beneath a point at which the heel plate joins the outsole.

18. The article of footwear of claim 17, wherein each rib has a first end located at a rear portion of a forefoot portion of the outsole and a second end located at a midfoot portion of the heel plate.

19. An article of footwear comprising, in combination:

an upper; and a sole structure secured to the upper and comprising:

an outsole secured to the upper;

a plurality of spikes extending outwardly from the outsole;

a plurality of projections extending outwardly from the outsole;

a heel plate from having a first end secured to a midfoot portion of the outsole and a second end positioned at a point below a heel portion of the outsole, the heel plate extending downwardly and rearwardly from the first end to the second end;

a plurality of projections extending outwardly from the heel plate;

a first support column extending between the outsole and the heel plate, the first column positioned in a lateral portion of the heel portion of the outsole; and a second support column extending between the outsole and the heel plate, the second column positioned in a medial portion of the heel portion of the outsole and forwardly of the first support column.

20. The article of footwear of claim 19, further comprising a plurality of ribs, each rib extending beneath a point at which the heel plate joins the outsole.

21. The article of footwear of claim 20, wherein each rib has a first end located at a rear portion of a forefoot portion of the outsole and a second end located at a midfoot portion of the heel plate.

22. An article of footwear comprising, in combination:

an upper; and a sole structure secured to the upper and comprising:

a midsole secured to the upper;

an insole positioned within the upper above the midsole;

an outsole secured to the midsole;

a plurality of spikes extending outwardly from the outsole;

a plurality of projections extending outwardly from the outsole;

a heel plate having a first end secured to a midfoot portion of the outsole and a second end positioned at a point below a heel portion of the outsole, the heel plate extending downwardly and rearwardly from the first end to the second end;

a plurality of projections extending outwardly from the heel plate;

a first support column extending between the outsole and the heel plate, the first column positioned in a lateral portion of the heel portion of the outsole; and a second support column extending between the outsole and the heel plate, the second column positioned in a medial portion of the heel portion of the outsole and forwardly of the first support column.

* * * * *